US005102574A

United States Patent [19]

Russell et al.

[11] Patent Number: 5,102,574

[45] Date of Patent: Apr. 7, 1992

[54] LIQUID NON-AQUEOUS DETERGENTS COMPRISING NARROW-RANGE ETHOXYLATES

[75] Inventors: Stephen W. Russell, Maasland; Alan D. Tomlinson, Vlaardingen, both of Netherlands

[73] Assignee: Lever Brothers Company, Division of Conopco, Inc., New York, N.Y.

[21] Appl. No.: 482,468

[22] Filed: Feb. 21, 1990

[30] Foreign Application Priority Data

Feb. 27, 1989 [GB] United Kingdom ..... 8904415

[51] Int. Cl.[5] ..... C11D 1/68; C11D 3/075; C11D 7/10; C11D 3/12

[52] U.S. Cl. ..... 252/174.21; 252/94; 252/102; 252/104; 252/135; 252/139; 252/163; 252/544; 252/174.12; 252/174.14; 252/174.25; 252/DIG. 14

[58] Field of Search ..... 252/174.22, 117, 135, 252/174.21, 174.12, 174.25, 94, 102, 104, 139, 163, 544, 174.14, DIG. 14

[56] References Cited

U.S. PATENT DOCUMENTS

| | | | |
|---|---|---|---|
| 4,206,070 | 6/1980 | Jones | 252/117 |
| 4,264,466 | 4/1981 | Carleton et al. | 252/99 |
| 4,326,979 | 4/1982 | Bus et al. | 252/156 |
| 4,453,023 | 6/1984 | McCain et al. | 568/618 |
| 4,540,828 | 9/1985 | Yang | 568/616 |
| 4,568,774 | 2/1986 | Yang | 568/616 |
| 4,593,142 | 6/1986 | Yang | 568/618 |
| 4,754,075 | 6/1988 | Knopf et al. | 568/618 |
| 4,775,653 | 10/1988 | Leach et al. | 502/170 |
| 4,883,610 | 11/1989 | Ciallella | 252/174.22 |
| 4,886,917 | 12/1989 | Knopf et al. | 568/623 |

FOREIGN PATENT DOCUMENTS

| | | |
|---|---|---|
| 026546 | 4/1981 | European Pat. Off. . |
| 181212 | 5/1986 | European Pat. Off. . |
| 2194955 | 3/1988 | United Kingdom . |

OTHER PUBLICATIONS

GB 2,196,981 (Colgate) (Abstract enclosed).
GB 2,195,124 (Colgate) (Abstract enclosed).
GB 2,179,364 (Colgate) (Abstract enclosed).
Matheson, Matson and Yang (Jaocs, vol. 63, No. 3, Mar. 1986).
Dillan, Johnson, Siracusa (Soap Cosmetics, Chemical Specialities, Mar. 1986).
Research Disclosure Sep. 1981 No. 20945.
Research Disclosure Jun. 1980 No. 19410.
BP Brochure: Softanol: Biodegradable Surfactants.
Dobanol Technical Bulletin UD/014 (Attachment A) 09/1983.
Bulletin relating to the Physical and Chemical Properties of Dobanol, including Dobanol 91 (Attachment B), date presumably before 2/12/90.
Enclosure "A" relating to Dobanol Surfactants.
Enclosure "B" relating to the Alkyl distribution of various Dobanol 91 Materials.

*Primary Examiner*—Paul Lieberman
*Assistant Examiner*—Erin M. Higgins
*Attorney, Agent, or Firm*—Ronald A. Koatz

[57] ABSTRACT

A substantially non-aqueous liquid detergent product comprising a liquid surfactant phase and a solid phase dispersed therein, the liquid surfactant phase comprising an ethoxylated alcohol having an average of from 5 to 8 ethylene oxide (EO) groups per molecule, at least 60% having a number of ethylene oxide groups within ±2EO of the average and the alkyl chain distribution being such that less than 2% has a chain length of 9 or less carbon atoms, at least 90% has a chain length between 10 and 12 carbon atoms and less than 10% has a chain length of 13 or more carbon atoms, said percentages being by weight of the ethoxylated alcohol.

4 Claims, No Drawings

LIQUID NON-AQUEOUS DETERGENTS COMPRISING NARROW-RANGE ETHOXYLATES

The present invention relates to a substantially non-aqueous liquid cleaning product of the kind comprising solid particles dispersed in a liquid surfactant phase, the solid particles being, for example detergency builders, bleaches and bleach activators and electrolyte. salts.

Non-aqueous detergent liquids have been proposed for a number of uses, such as fabric washing and dish-washing. They have advantages over powder products at least in that they are more rapidly dispersed in water and they have advantages over aqueous liquid products at least in that they are capable of including water-sensitive ingredients such as bleaches.

The liquid phase, often referred to as a liquid "solvent" although it is not essential that any ingredients of the product need necessarily dissolve in this phase, usually comprises a nonionic surfactant.

Such a material is found to be a suitable liquid medium and usefully provides the product with a surfactancy function.

For use in non-aqueous liquid products the nonionic should ideally satisfy a number of criteria as follows i) It should be liquid over the normal temperature range at which the product will be used. Thus it is desirable to have a low pour point. Viscosity should also be low over this temperature range.

ii) It should be readily dispersible in water over the range of temperatures encountered during use, for example in the dispenser of an automatic washing machine. This temperature can vary from just over freezing point in winter to over 40° C. when a "hot fill" machine is used. The formation of a mesophase gel on dilution over this temperature range is therefore to be avoided.

iii) Compounds which are not substantially biodegradable are preferably avoided.

iv) It should have a low odor, which generally means that components or impurities with high volatility are preferably avoided.

v) It should be low foaming in the wash and rinse stages 30 of the cleaning process.

vi) It should provide satisfactory cleaning performance. This places restrictions upon the structure of the nonionic surfactant, such as its HLB, although to 35 some extent a high level of the surfactant in the product can make up for some deficiencies in this area.

vii) It should have a low reactivity with other ingredients of the formulation.

viii) It should have a low water content.

ix) It should have a low color and a low level of impurities.

x) It should provide a suitable liquid medium for stably suspending the solid phase, being compatible with any stabilization system which may be used. British patent specification GB 2194955A (Colgate) discloses non-aqueous liquid products comprising a $C_9$ to $C_{11}$ fatty alcohol ethoxylated with 5 moles of ethylene oxide, specifically the commercially available DOBANOL 91-5 ex Shell Chemical Company. We have found however that this material does not satisfy all the above criteria to a sufficient degree, in particular odor, foaming behaviur in the rinse and low gelling/mesophase behaviur on contact/dilution with water.

We have now surprisingly found that by the use of an ethoxylated alcohol and by close control of the degree of ethoxylation and chain length distribution improvements can be achieved.

Thus according to the invention there is provided a substantially non-aqueous liquid detergent product comprising a liquid surfactant phase and a solid phase dispersed therein, the liquid surfactant phase comprising an ethoxylated alcohol having an average of from 5 to 8 ethylene oxide (EO) groups per molecule, at least 60% having a number of ethylene oxide groups within ±2EO of the average and the alkyl chain distribution being such that less than 2% has a chain length of 9 or less carbon atoms, at least 90% has a chain length between 10 and 12 carbon atoms and less than 10% has a chain length of 13 or more carbon atoms, said percentages being by weight of the ethoxylated alcohol.

Nonionic surfactants for use in products according to the invention preferably have less than 2% 1EO molecules, from 2.5% to 4.5% 2EO molecules, less than 2% unethoxylated $C_{10}$ to $C_{12}$ alcohol, less than 5% molecules with 12 or more EO groups and less than 1% molecules with 14 or more EO groups. For reasons of biodegradability, ethoxylated primary alcohols are preferred.

Nonionic surfactants for use within the broad scope of the invention have been described in the art. Thus, for example, Research Disclosures, June 1980, 19410 (Conoco Inc, U.S.A.) describes peaked distribution ethoxylates, specifically ALFONIC 1612-60 and ALFONIC 1012-60, the latter of which is believed to be a $C_{10}$ to $C_{12}$ alcohol ethoxylated with an average of about 7 moles of ethylene oxide. Such nonionics are said to exhibit greater liquidity and solubility and better dish-washing detergency. However, the art has not previously suggested the benefit of peaked nonionics in non-aqueous liquid detergent products. Other disclosures in the art concerning the preparation of peaked nonionic surfactants include U.S. Pat. Nos. 4,775,653, 4,568,774, 4,593,142, 4,540,828 (VISTA CHEMICALS) and U.S. Pat. Nos. 4,754,075, 4,453,023 and EP 26546 (UNION CARBIDE).

Although materials such as peaked ALFONIC 1012-60 have been described in the literature, we prefer to use a material obtained by the ethoxylation of an alcohol with a narrow range of carbon chain lengths. Such an alcohol is LIAL 111 (ex ENICHEM, ITALY) which has predominantly $C_{11}$ chains without the presence of shorter chain odiferous materials. This material can be ethoxylated by means well known in the art to an average of about 7 ethylene oxide groups per molecule. A suitable method for the preparation by Matheson, Matson and Yang in JAOCS, vol. 63, No. 3 (March 1986) pp 365–370, and such a method may be employed in the preparation of the nonionic surfactants useful in the present invention. Another preferred material is NRE from Vista, a material based on an even numbered straight chain alcohol mixture which has predominantly $C_{10}$ chains without the presence of high amounts shorter chain odiferous materials, ethoxylated with about 6 ethylene oxide groups per molecule. Other suitable materials are the Dobanol NRE materials ex Shell.

Thus according to a second feature of the invention there is provided a liquid nonionic surfactant suitable for use in non-aqueous liquid detergent products, the surfactant being an ethoxylated alcohol, the alcohol having an alkyl chain which is predominantly 11 carbon atoms in length, the alkyl chain distribution being such that less than 2% has a chain length of 9 or less carbon atoms and less than 10% has a chain length of 13 or more carbon atoms, and the alcohol having an average of more than 6 and less than 8 ethylene oxide (EO) groups per molecule, at least 60% having from 5 to 9 EO group per molecule, less than 2% having 1 EO group per molecule, from 2.5% to 4.5% having 2 EO groups per molecule, less than 5% having 12 or more EO groups per molecule and less than 1% having 14 or more EO groups per molecule, said percentages being by weight of the ethoxylated alcohol.

Thus according to a third feature of the invention there is provided a liquid nonionic surfactant suitable for use in non-aqueous liquid detergent products, the surfactant being an ethoxylated alcohol, the alcohol having an alkyl chain which is pre-dominantly 10 carbon atoms in length, the alkyl chain distribution being such that less than 2% has a chain length of 8 or less carbon atoms and less than 10% has a chain length of 14 or more carbon atoms, and the alcohol having an average of more than 6 and less than 8 ethylene oxide (EO) groups per molecule, at least 60% having from 5 to 9 EO group per molecule, less than 2% having 1 EO group per molecule, from 2.5% to 4.5% having 2 EO groups per molecule less less than 1% having 14 or more EO groups per molecule, said percentages being by weight of the ethoxylated alcohol.

In addition to the alcohol ethoxylated referred to above, products according to the invention may contain other surfactant materials as part of the liquid phase and/or dispersed as a solid phase, as described in more detail below.

The solid phase may be dispersed in the compositions of the present invention by any means known in the art.

Preferably, the compositions of the present invention also contain one or more dispersants for modifying the rheology of the dispersion. Most preferred are the deflocculants described in our patent specification published under number EP-A-266 199, for example dodecyl benzene sulphonic acid or lecithin.

Alternatively or additionally, other known dispersants which may be used are the highly voluminous inorganic carrier materials described in GB patent specifications 1 205 711 and 1 270 040, chain structure-type clays as described in EP-A-34 387, certain hydrolyzable copolymers according to EP-A-28 849, organic phosphorus compounds having an acidic -POH group as related in GB 2 158 453 and J 61 227 832, aluminium or alkali metal salts of higher carboxylic acids as disclosed in GB 2 172 897 and GB 2 200 366, cationic quaternary amine salt surfactants, urea, a substituted-urea or -guanidine according to GB 2 179 346 or J 61 227 829, or substituted urethanes, according to J 61 227 830. Other such materials are polyether carboxylic acids as described in GB 2 158 454, certain aliphatic di- or cyclic-carboxylic acids according to GB 2 177 716, fatty acid alkanolamide di-esters as disclosed in J 61 227 828, or analogous compounds formed as a partial ester of carboxylated polymer, according to J 61 227832.

Some of the materials mentioned above for auxiliary rheology control also a have a subsidiary function, for example as surfactants or detergency builders.

All compositions according to the present invention are liquid detergent products. They may be formulated in a very wide range of specific forms, according to the intended use. They may be formulated as cleaners for hard surfaces (with or without abrasive) or as agents for warewashing (cleaning of dishes, cutlery etc) either by hand or mechanical means, as well as in the form of specialized cleaning products, such as for surgical apparatus or artificial dentures. They may also be formulated as agents for washing and/or conditioning of fabrics.

Those products which are formulated for the cleaning and/or conditioning of fabrics constitute an especially preferred form of the present invention because in that role, there is a very great need to be able to incorporate substantial amounts of various kinds of solids. These compositions may for example, be of the kind used for pre-treatment of fabrics (e.g. for spot stain removal) with the composition neat or diluted, before they are rinsed and/or subjected to a main wash. The compositions may also be formulated as main wash products, being dissolved and/or dispersed in the water with which the fabrics are contacted. In that case, the composition may be the sole cleaning agent or an adjunct to another wash product.

The compositions will be substantially free from agents which are detrimental to the article(s) to be treated.

For example, they will be substantially free from pigments or dyes, although of course they may contain small amounts of those dyes (colorants) of the kind often used to impart a pleasing color to liquid cleaning products, as well as fluorescers, bluing agents and the like.

Other nonionic detergent surfactants which may also be present in compositions of the present inventions, ideally in only minor proportions, are well-known in the art. They normally consist of a water-solubilizing polyalkoxylene or a mono- or di-alkanolamide group in chemical combination with an organic hydrophobic group derived, for example, from alkylphenols in which the alkyl group contains from about 6 to about 12 carbon atoms, monocarboxylic acids having from 10 to about 24 carbon atoms in the alkyl group and polyoxypropylenes. Also common are fatty acid mono- and dialkanolamides in which the alkyl group of the fatty acid radical contains from 10 to about 20 carbon atoms and the alkyloyl group having from 1 to 3 carbon atoms. In any of the mono- and di-alkanolamide derivatives, optionally, there may be a polyoxyalkylene moiety joining the latter groups and the hydrophobic part of the molecule. In these polyalkoxylene containing surfactants, the polyalkoxylene moiety preferably consists of from 2 to 20 groups of ethylene oxide or of ethylene oxide and propylene oxide groups. Amongst the latter class, particularly preferred are those described in the applicants' published European specification EP-A-225,654.

Another class of suitable nonionics which may be incorporated, preferably at most in minor quantities, comprise the alkyl polysaccharides (polyglycosides-/oligosaccharides) such as described in any of U.S. Pat. Nos. 3,640,998; 3,346 558; 4,223,129; EP-A-92,355; EP-A-99,183; EP-A-70,074, '75, '76, '77; EP-A-75,994, '95, '96.

Nonionic detergent surfactants normally have molecular weights of from about 300 to about 11,000. When mixtures of different nonionic detergent surfactants are used, it is preferred that the mixture is liquid, at room temperature. Mixtures of nonionic detergent surfactants with other detergent surfactants such as anionic, cationic or ampholytic detergent surfactants and soaps may also be used.

Examples of suitable anionic detergent surfactants, which may be used, preferably at most, in minor quantities, are alkali metal, ammonium or alkylolamaine salts of alkylbenzene sulphonates having from 10 to 18 carbon atoms in the alkyl group, alkyl and alkylether sulphates having from 10 to 24 carbon atoms in the alkyl group, the alkylether sulphates having from 1 to 5 ethylene oxide groups, olefin sulphonates prepared by sulphonation of $C_{10-24}$ alpha-olefins and subsequent neutralization and hydrolysis of the sulphonation reaction product.

Other surfactants which may be used, preferably at most in minor quantities, include alkali metal soaps of a fatty acid, preferably one containing 12 to 18 carbon atoms. Typical such acids are oleic acid, ricinoleic acid and fatty acids derived from caster oil, rapeseed oil, groundnut oil, coconut oil, palmkernal oil or mixtures thereof. The sodium or potassium soaps of these acids can be used. As well as fulfilling the role of surfactants, soaps can act as detergency builders or fabric conditioners, other examples of which will be described in more detail hereinbelow. It can also be remarked that the oils mentioned in this paragraph may themselves constitute all or part of the liquid phase, whilst the corresponding low molecular weight fatty acids (triglycerides) can be dispersed as solids or function as structurants.

Yet again, it is also possible to utilize small amounts of cationic, zwitterionic and amphoteric surfactants such as referred to in the general surfactant texts referred to hereinbefore. Examples of cationic detergent surfactants are aliphatic or aromatic alkyl-di(alkyl) ammonium halides and examples of soaps are the alkali metal salts of $C_{12-24}$ fatty acids. Ampholytic detergent surfactants are e.g. the sulphobetalnes. Combinations of surfactants from within the same, or from different classes may be employed to advantage for optimizing structuring and/or cleaning performance.

Non-surfactants which are suitable for inclusion in the liquid phase include ethers, polyethers, alkylamines and fatty amines, (especially di- and tri-alkyl- and/or fatty- N-substituted anlines), alkyl (or fatty) amides and mono- and di- N-alkyl substituted derivatives thereof, alkyl (or fatty) carboxylic acid lower alkyl esters, ketones, aldehydes, and glycerides. Specific examples include respectively, di-alkyl ethers, polyethylene glycols, alkyl ketones (such as acetone), glycerol, propylene glycol, and sorbitol.

The compositions of the invention may contain the liquid phase in an amount of at least 10% by weight of the total composition. The amount of the liquid phase present in the composition may be as high as about 90%, but in most cases the practical amount will lie between 20 and 70% and preferably between 20 and 50% by weight of the composition.

The compositions according to the present invention preferably also contain one or more other functional ingredients, for example selected from detergency builders, bleaches, and (for hard surface cleaners) abrasives.

The detergency builders are those materials which counteract the effects of calcium, or other ion, water hardness, by precipitation, by an ion sequestering or ion-exchange effect. They comprise both inorganic and organic builders. They may also be sub-divided into the phosphorus-containing and non-phosphorus types, the latter being preferred when environmental considerations are important. The level of builder materials is preferably from 0–60% by weight of the composition, more preferred from 10–50%, most preferred from 20–40%.

In general, the inorganic builders comprise the various phosphate-, carbonate-, silicate-, borate- and aliminosilicate-type materials, particularly the alkali-metal salt forms. Mixtures of these may also be used.

Examples of phosphorus-containing inorganic builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic builders, when present, include water-soluble alkali metal carbonates, bicarbonates, borates silicates, metasilicates, and crystalline and amorphous alumino silicates. Specific examples include sodium carbonate (with or without calcite seeds), potassium carbonate, sodium and potassium bicarbonates, silicates and zeolites.

Examples of organic builders include the alkali metal, ammonium and substituted, citrates, succinates, malonates, fatty acid sulphonates, carboxymethoxy succinates, ammonium polyacetates, carboxylates, polycarboxylates, aminopolycarboxylates, polyacetyl carboxylates and polyhydroxsulphonates. Specific examples include sodium, potassium, lithium, ammonium and substituted anmonium salts of ethylenediaminetetraacetic acid, nitrilotriacetic acid, oxydisuccinic acid, melitic acid, benzene polycarboxylic acids and citric acid. Other examples are organic phosphonate type sequestering agents such as those sold by Monsanto under the tradename of the Dequest range and alkanehydroxy phosphonates.

Other suitable organic builders include the higher molecular weight polymers and co-polymers known to have builder properties, for example appropriate polyacrylic acid, polymaleic acid and polyacrylic/-polymaleic acid co-polymers usually as their alkali metal salts, such as those sold by BASF under the Sokalan Trade Mark.

The aluminosilicates are an especially preferred class of non-phosphorus inorganic builders. The aluminosilicates are for example crystalline or amorphous materials having the general formula:

$$Na_Z, (AlO_2)_Z (SiO_2)_Y x H_2O$$

wherein Z and Y are integers of at least 6, the molar ratio of Z to Y is in the range from 1.0 to 0.5, and x is an integer from 6 to 189 such that the moisture content is from about 4% to about 20% by weight (termed herein, 'partially hydrated'). This water content provides the best rheological properties in the liquid. Above this level (e.g. from about 19% to about 28% by weight water content), the water level can lead to network formation. Below this level (e.g. from 0 to about 6% by weight water content), trapped gas in pores of the material can be displaced which causes gassing and tends to lead to a viscosity increase also. However, it will be recalled that anhydrous materials (i.e. with 0 to about 6% by weight of water) can be used as structurants. The preferred range of aluminosilicate is from about 12% to about 30% on an anhydrous basis. The aluminosilicate preferably has a particle size of from 0.1 to 100 microns, ideally between 0.1 and 10 microns and a calcium ion exchange capacity of at least 200 mg calcium carbonate/g.

Suitable bleaches include the halogen, particularly chlorine bleaches such as are provided in the form of alkalimetal hypohalites, e.g. hypochlorites. In the application of fabrics washing, the oxygen bleaches are preferred, for example in the form of an inorganic persalt, preferably with an precursor, or as a peroxy acid compound.

In the case of the inorganic persalt bleaches, the precursor makes the bleaching more effective at lower temperatures, i.e. in the range from ambient temperature to about 60° C., so that such bleach systems are commonly known as low-temperature bleach systems and are well known in the art. The inorganic persalt such as sodium perborate, both the monohydrate and the tetrahydrate, acts to release active oxygen in solution, and the precursor is usually an organic compound having one or more reactive acyl residues, which cause the formation of peracids, the latter providing for a more effective bleaching action at lower temperatures than the peroxybleach compound alone. The ratio by weight of the peroxy bleach compound to the precursor is from about 15:1 to about 2:1, preferably from about 10:1 to about 3.5:1. Whilst the amount of the bleach system, i.e. peroxy bleach compound and precursor, may be varied between about 5% and about 35% by weight of the total liquid, it is preferred to use from about 6% to about 30% of the ingredients forming the bleach system. Thus, the preferred level of the peroxy bleach compound in the composition is between about 5.5% and about 27% by weight, while the preferred level of the precursor is between about 0.5% and about 40%, most preferably between about 1% and about 5% by weight.

Typical examples of the suitable peroxybleach compounds are alkalimetal peroborates, both tetrahydrates and monohydrates, alkali metal percarbonates, persilicates and perphosphates, of which sodium perborate is preferred.

Precursors for peroxybleach compounds have been amply described in the literature, including in British patent specifications 836,988, 855,735, 907,356, 907,358, 907,950, 1,003,310, and 1,246,339, U.S. Pat. Nos. 3,332,882, and 4,128,494, Canadian patent specification 844,481 and South African patent specification 68/6,344.

The exact mode of action of such precursors is not known, but it is believed that peracids are formed by reaction of the precursors with the inorganic peroxy compound, which peracids then liberate active-oxygen by decomposition.

They are generally compounds which contain N-acyl or O-acyl residues in the molecule and which exert their activating action on the peroxy compounds on contact with these in the washing liquor.

Typical examples of precursors within these groups are polyacylated alkylene diamines, such as N,N,N$^1$,N$^1$-tetraacetylethylene diamine (TAED) and N,N,N$^1$,N$^1$-tetraacetylmethylene diamine (TAMD); acylated glycolurils, such as tetraacetylgylcoluril (TAGU); triacetylcyanurate and sodium sulphophenyl ethyl carbonic acid ester.

A particularly preferred precursor is N,N,N$^1$,N$^1$-tetraacetylethylene diamine (TAED).

The organic peroxyacid compound bleaches are preferably those which are solid at room temperature and most preferably should have a melting point of at least 50° C. Most commonly, they are the organic peroxyacids and water-soluble salts thereof having the general formula

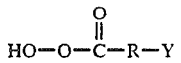

wherein R is an alkylene or substituted alkylene group containing 1 to 20 carbon atoms or an arylene group containing from 6 to 8 carbon atoms, and Y is hydrogen, halogen, alkyl, aryl or any group which provides an anionic moiety in aqueous solution.

Another preferred class of peroxygen compounds which can be incorporated to enhance dispensing/dispersibility in water are the anhydrous perborates described for that purpose in the applicants' European patent specification EP-A-217,454.

If the liquid phase comprises an ester formed from an organic acid and an alkoxylated alcohol nonionic detergent, the ester can act as a precursor for a persalt bleach in obviating the need for any other conventional precursor. These esters can also lower the pour point of the composition.

When the composition contains abrasives for hard surface cleaning (i.e. is a liquid abrasive cleaner), these will inevitably be incorporated as particulate solids. They may be those of the kind which are water insoluble, for example calcite. Suitable materials of this kind are disclosed in the applicants' patent specifications EP-A-50,887; EP-A-80,221; EP-A-140,452; EP-A-214,540 and EP 9,942, which relate to such abrasives when suspended in aqueous media. Water soluble abrasives may also be used.

The compositions of the invention optionally may also contain one or more minor ingredients such as fabric conditioning agents, enzymes, perfumes (including deoperfumes), micro-biocides, coloring agents, fluorescers, soil-suspending agents (anti-redeposition agents), corrosion inhibitors, enzyme stabilizing agents, and lather depressants.

In general, the solids content of the product may be within a very wide range, for example from 1–90%, usually from 10–80% and preferably from 15–70%, especially 15–50% by weight of the final composition. The alkaline salt should be in particulate form and have an average particle size of less than 300 microns, preferably less than 200 microns, more preferably less than 100 microns, especially less than 10 microns. The particle size may even be of 20 sub-micron size. The proper particle size can be obtained by using materials of the appropriate size or by milling the total product in a suitable milling apparatus.

The compositions are substantially non-aqueous, i.e. they little or no free water, preferably no more than 5%, preferably less than 3%, especially less than 1% by weight of the total composition. It has been found by the applicants that the higher the water content, the more likely it is for the viscosity to be too high, or even for setting to occur. However, this may at least in part be overcome by use of higher amounts of, or more effective deflocculants or other dispersants.

Since the objective of a non-aqueous liquid will generally be to enable the formulator to avoid the negative influence of water on the components, e.g. causing incompatibility of functional ingredients, it is clearly necessary to avoid the accidental or deliberate addition of water to the product at any stage in its life. For this reason, special precautions are necessary in manufacturing procedures and pack designs for use by the consumer.

Thus during manufacture, it is preferred that all raw materials should be dry and (in the case of hydratable salts) in a low hydration state, e.g. anhydrous phosphate builder, sodium perborate monohydrate and dry calcite abrasive, where these are employed in the composition. In a preferred process, the dry, substantially anhydrous solids are blended with the liquid phase in a dry vessel. In order to minimize the rate of sedimentation of the solids, this blend is passed through a grinding mill or a combination of mills, e.g. a colloid mill, a corundum disc mill, a horizontal or vertical agitated ball mill, to achieve a particle size of 0.1 to 100 microns, preferably 0.5 to 50 microns, ideally 1 to 10 microns. A preferred combination of such mills is a colloid mill followed by a horizontal ball mill since these can be followed by a horizontal ball mill since these can be operated under the conditions required to provide a narrow size distribution in the final product. Of course particulate material already having the desired particle size need not be subjected to this procedure and if desired, can be incorporated during a later stage of processing.

During this milling procedure, the energy input results in a temperature rise in the product and the liberation of air entrapped in or between the particles of the solid ingredients. It is therefore highly desirable to mix any heat sensitive ingredients into the product after the milling stage and a subsequent cooling step. It may also be desirable to de-aerate the product before addition of these (usually minor) ingredients and optionally, at any other stage of the process. Typical ingredients which might be added at this stage are perfumes and enzymes, but might also include highly temperature sensitive bleach components or volatile solvent components which may be desirable in the final composition. However, it is especially preferred that volatile material be introduced after any step of de-aeration. Suitable equipment for cooling (e.g. heat exchangers) and de-aeration will be known to those skilled in the art.

It follows that all equipment used in this process should be completely dry, special care being taken after any cleaning operations. The same is true for subsequent storage and packing equipment.

The invention will now be illustrated by way of example.

EXAMPLE I-III

The following liquid product was prepared.

| Ingredients | % (wt) I-III |
|---|---|
| Nonionic surfactant[1] | 27.5 |
| Glyceryl triacetate | 12.5 |
| ABS acid[2] | 4.0 |
| Soap | 2.0 |
| Silica[3] | 0.3 |
| Sodium carbonate | 27.5 |
| Sodium disilicate | 3.5 |
| Sodium perborate monohydrate | 11.0 |
| TAED | 4.0 |
| CP5 polymer[4] | 4.0 |
| Minor ingredients | balance |

Notes

[1]For example I: LIAL 111 ethoxylated with an average of 7 ethylene oxide groups per molecule according to the method disclosed in Matheson, Matson and Young, JAOCS 1986 referred to above.

For example II: NRE ex Vista an ethoxylated material based on an even numbered straight chain alcohol mixture with approximate chain distribution $C_8$ 0.1%, $C_{10}$ 87%, $C_{12}$ 7.5% and $C_{14}$ 5%, the EO distribution peaks at $EO_7$ (21%) and contains little EO molecules longer than $EO_{12}$ ($EO_{12}$ = 0.5%) and only 0.6% of unreacted alcohol.

For -comparative- example III: Dobanol 91-5 ex Shell.

[2]Alkyl (ie. dodecyl) benzene sulphonic acid (as free acid).

[3]Highly voluminous silica (Aerosil).

[4]SOKALAN CP5 which is an acrylic acid/maleic acid copolymer in the sodium salt form.

The compositions in accordance with examples I and II were less odiferous than the composition of Example III.

We claim:

1. A substantially non-aqueous liquid detergent product comprising a liquid surfactant phase and a solid phase dispersed therein, the liquid surfactant phase comprising an ethoxylated alcohol having an average of from 5 to 8 ethylene oxide (EO) groups per molecule, at least 60% having a number of ethylene oxide groups within ±2EO of the average and the alkyl chain distribution being such that less than 2% has a chain length of 9 or less carbon atoms, at least 90% has a chain length between 10 and 12 carbon atoms, and wherein less than 2% of the ethoxylated alcohol has 1EO group per molecule and from 2.5% to 4.5% of the ethoxylated alcohol has 2EO groups per molecule, said percentages being by weight of the ethoxylated alcohol.

2. A product as claimed in claim 1, containing less than 4%, based on the weight of the ethoxylated alcohol, of unethoxylated alcohol with 10 to 12 carbon atoms.

3. A product as claimed in claim 1, wherein less than 5% of the ethoxylated alcohol has 12 or more EO groups.

4. A product as claimed in claim 1, wherein less than 1% of the ethoxylated alcohol has 14 or more EO groups.

* * * * *